US006282827B1

(12) United States Patent
Holmes

(10) Patent No.: US 6,282,827 B1
(45) Date of Patent: Sep. 4, 2001

(54) PICTURE FRAME AND STAND THEREFOR

(76) Inventor: Kenneth Holmes, Upper Dee Mill, Llangollen, Denbighshire LL20 8SD (GB)

( * ) Notice: Subject to any disclaimer, the term of this patent is extended or adjusted under 35 U.S.C. 154(b) by 0 days.

(21) Appl. No.: 09/307,930

(22) Filed: May 10, 1999

(30) Foreign Application Priority Data

Feb. 4, 1999 (GB) ..... 9902357
Feb. 19, 1999 (GB) ..... 9903883

(51) Int. Cl.[7] ..... A47G 1/16

(52) U.S. Cl. ..... 40/748; 40/745; 40/747; 40/759; 40/761; 40/762; 248/469

(58) Field of Search ..... 40/745, 747, 748, 40/759, FOR 152.1, 761, 762, 746, 120; 248/468, 469, 473

(56) References Cited

U.S. PATENT DOCUMENTS

| | | | | |
|---|---|---|---|---|
| 896,753 | * | 8/1908 | Peterson | 40/747 |
| 1,820,841 | | 8/1931 | Soref . | |
| 2,016,942 | * | 10/1935 | Horwitt et al. | 40/739 |
| 2,450,495 | * | 10/1948 | Ullmann | 40/762 |
| 2,630,992 | * | 3/1953 | Seeiman | 40/746 X |
| 2,954,630 | * | 10/1960 | Hull | 40/761 |
| 3,074,680 | * | 1/1963 | Stewart | 40/759 X |
| 3,990,670 | | 11/1976 | Frechtman | 248/470 |
| 5,713,148 | * | 2/1998 | Lovison | 40/776 |

FOREIGN PATENT DOCUMENTS

| | | | | |
|---|---|---|---|---|
| 893829 | | 11/1944 | (FR) . | |
| 2.034.273 | | 12/1970 | (FR) . | |
| 28737 | | of 1913 | (GB) . | |
| 176079 | * | 2/1922 | (GB) | 40/152.1 |
| 345138 | * | 3/1931 | (GB) | 40/152.1 |
| 92504 | | 5/1959 | (NL) . | |

* cited by examiner

*Primary Examiner*—B. Dayoan
*Assistant Examiner*—Andrea Chop
(74) *Attorney, Agent, or Firm*—Lahive & Cockfield, LLP

(57) ABSTRACT

A stand for a picture frame has a leg is provided which can support the frame in a generally upright position. The stand comprises a bracket coupled to the rear of the frame and the leg is receivable by the bracket in either of a first orientation, in which the leg lies against or adjacent the rear of the frame to minimize the bulk of the stand, and a second orientation in which the leg projects backward from the frame to support it. Engagement of the leg and bracket is by a projection, which is preferably formed on the leg, and a slot, which is preferably defined by the bracket, the projection being insertable in the slot. The bracket may also be adapted to receive a hook for hanging the frame, e.g. by inclusion of an appropriate cut-away.

29 Claims, 4 Drawing Sheets

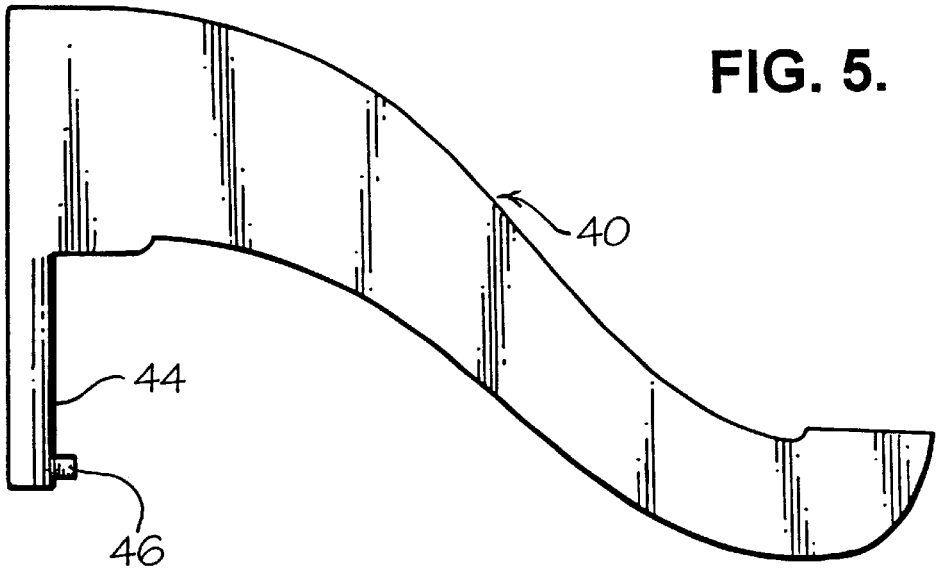
FIG. 5.
FIG. 6.
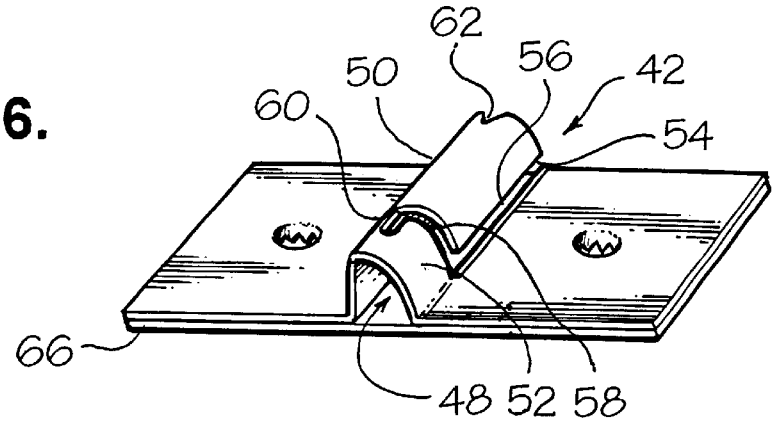
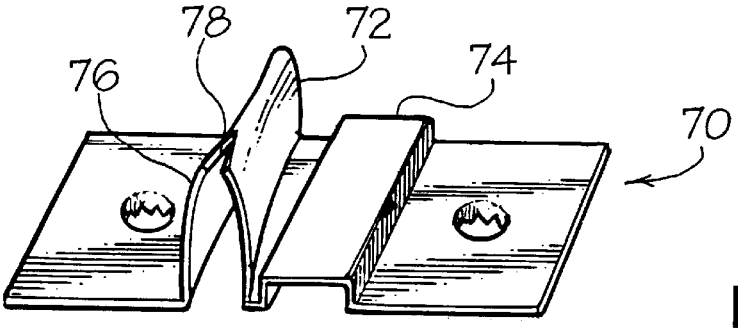
FIG. 7.

PICTURE FRAME AND STAND THEREFOR

BACKGROUND OF THE INVENTION

The present invention is concerned with stands, particularly stands for picture frames, and with picture frames as such.

There is a long standing need for picture frames which can stand upright on a desk, shelf etc. and which can be economically manufactured for a mass market. Frames of this general type exist.

One such mass produced picture frame has a perimeter frame, e.g. of wood with mitred comer joints or alternatively of plastics, a transparent front panel of plastics or glass, and a rear opaque panel typically of fibre board or plastics. The picture—be it a painting, photograph, print etc.—is sandwiched between the front and rear panels, which are themselves received in a recess formed around the rear of the perimeter frame and held in position typically by flexible metal tabs driven into the perimeter frame, which are bent into position against the rear panel. To enable the frame to stand upright, the rear panel has cuts or perforations preformed in it to define a leg which can be bent backwardly out of the plane of the panel. The cuts do not form a closed loop, so that the leg and the panel remain connected through a region of material which, being flexible, acts as a hinge. The frame can thus be rested on a horizontal surface, being upright but inclined somewhat backwardly with the leg serving to prevent it from falling backward.

An alternative construction uses a leg formed separately from the frame's rear panel but coupled thereto through a hinge.

While commercially successful, such frames are not without shortcomings. Their appearance is not appropriate in some contexts; the leg can sometimes fold inward allowing the frame to topple backward, and abuse can cause the material forming the hinge for the leg to fail.

SUMMARY OF THE INVENTION

An object of the present invention is to provide an improved stand for a picture frame and an improved free standing picture frame. It is particularly desired to provide a frame with a stand which can support the frame but whose bulk can be minimized for storage, and to ensure that when supporting the frame the stand is adequately located to prevent motion of the stand which would allow toppling of the frame.

In accordance with the present invention, there is a stand for a picture frame comprising a bracket for coupling to the rear of the frame and a leg, one of the leg and the bracket defining at least one slot and the other of the leg and the bracket comprising a projection receivable in the slot(s) to thereby mount the leg on the frame, the leg and the slot(s) being shaped such that use the leg can be thereby mounted on the frame in either of a first orientation relative to the frame in which the leg lies generally parallel to the rear of the frame to minimize bulk and a second orientation relative to the frame in which the leg projects backward from the frame and can thus support the frame in a standing position.

Registration of the leg's projection with the slot can provide an adequately positive means of maintaining the leg in either of its positions, while the facility to dispose the leg against or adjacent the rear surface of the frame allows the space taken up by the frame to be minimized for packing, storage, transport etc. The stand according to the present invention can if desired be economically manufactured from plastics and/or pressed metal sheet and/or shaped metal wire.

It is especially preferred that the projection is receivable along a direction which is generally upright with respect to the frame's standing position. In such embodiments the leg preferably has a surface which contacts the rear face of the frame in use and so resists rotational movement of the leg relative to the frame.

The leg and the bracket can be separately formed. They are preferably not fixedly coupled together.

To achieve a simple structure, the leg may be formed as a single component of sheet material. It may be stamped from sheet metal.

The leg preferably has a support portion which meets the projection in an elbow, the support portion extending backwardly from the frame when the leg is in its second orientation to rest on the supporting surface and so support the frame in its generally upright position.

In the currently preferred embodiment of the present invention, the projection and the slot are shaped to register in a manner such that following insertion of the projection into the slot the leg cannot be moved from its first to its second orientation without first being withdrawn from the slot.

In one preferred embodiment of the present invention, the slot in the bracket is generally "L" shaped in cross section, the projection being generally rectangular in cross section and so receivable by the slot in at least two different orientations, one substantially perpendicular to the other. A "T" shaped cross section can also be used for the slot, although this form of the invention is not currently preferred.

In an alternative embodiment of the present invention, the slot has a square cross section. The leg projection may have a square cross section. Such an embodiment may comprise a leg comprising shaped square section wire.

In still another preferred embodiment of the present invention, the bracket defines two differently orientated slots such that the leg lies in the first orientation when received in one slot and in the second orientation when received in the other. A preferred construction of this embodiment comprises a bracket part formed of metal sheet, the two slots being parallel and separated by an intermediate portion of the sheet.

Preferably, the projection is insertable into the slot in a generally downward direction, the slot being upwardly open. It might be imagined that subsequent upward pressure exerted on the support portion due to the weight of the frame would tend to displace the leg upwardly, but in fact the inventor has found that instead the force on the leg causes its projection to bind in its slot and thus to be maintained in position.

The bracket part is preferably formed of shaped sheet metal. For economical mass production, the bracket can be formed by stamping. It may be coupled to the rear of the frame by integrally formed dogs pressed out of the plane of the sheet metal and driven into a board forming the rear of the frame.

In yet a further preferred embodiment of the present invention, either the projection or the slot is formed with a guide path extending along at least part of its length, the other of these components being formed with a follower which is brought into registration with the guide path by insertion of the projection in the slot so that the orientation of the leg relative to the frame is thereby constrained, the shape of the guide path being such that motion of the projection along the slot in a certain direction causes the leg to move from its first orientation to its second orientation.

Thus in this version the leg need not be fully disengaged from the bracket part in order to be moved from one orientation from the other. In fact, this embodiment of the invention can provide a frame which operates, from the point of view of the user, in a particularly straightforward and elegant manner.

In such embodiments the leg and/or the bracket part may be formed of molded plastics.

However, a particularly preferred version of this embodiment of the present invention includes a bracket part having a metal plate defining a slot which is three sided and preferably shaped substantially as a ninety degree segment of a circle. The bracket part preferably has a guide path itself formed as a slot formed through the metal plate. To prevent relative motion of the parts of the metal plate on respective sides of the slot, they may be secured to a back plate. The corresponding leg is most preferably formed of sheet material with a follower formed as a stub on the projection, the stub being receivable in the slot.

Preferably the guide path is such that movement of the projection into the slot causes the leg to move from its first orientation to its second orientation. Such a guide path may be formed in or by the female part and have a first portion extending longitudinally of the slot and nearest the opening of the slot through which the leg is received, a second portion also extending longitudinally of the slot and further from the opening, and a third portion connecting the first and second portions, meeting each in a respective vertex, and extending laterally of the slot. In such an arrangement, the follower can be stably located at either of the vertices and thus retain the leg selectively in either of its orientations.

The guide path is preferably itself formed as a slot, the follower being formed as a projection receivable therein. It is especially preferred that the bracket is adapted to receive a pin, hook or other means for hanging the frame.

It is commonly required that a frame should be capable not only of free standing on a surface but also of being hung from a wall. This has conventionally required two separate devices on the rear of the frame—a stand and a loop, wire or similar means for engagement with a hook, pin etc. The present invention allows both functions to be achieved by one unit with a resultant cost saving which can be highly important in the mass market for low cost frames.

To receive the hanging means, the slot may be flared at one or both of its ends. Additionally or alternatively the bracket may have a cut-away, e.g. a "V" notch or hole for receiving the hanging means.

In accordance with a still broader aspect, the present invention provides a stand for maintaining in a standing orientation an item otherwise unstable in such orientation, the stand comprising a bracket for coupling to the item and a leg, one of the bracket and the leg defining at least one slot and the other of the bracket and the leg comprising a project receivable in the slot to thereby mount the leg on the item, the leg and the slot(s) being shaped such that the leg can be thereby mounted on the item in either of a first orientation in which the leg lies adjacent a surface of the item to minimise bulk and a second orientation in which the leg projects from the item suitable to support the item in the standing orientation.

BRIEF DESCRIPTION OF THE DRAWINGS

Specific embodiments of the present invention will now be described, by way of example only, with reference to the accompanying drawings, in which:

FIG. 5 illustrates a leg forming part of a third embodiment of the present invention;

FIG. 6 illustrates in perspective a bracket forming part of the third embodiment;

FIG. 7 illustrates in perspective a bracket forming part of a fourth embodiment of the present invention;

DESCRIPTION OF THE PREFERRED EMBODIMENTS

Figure 1:
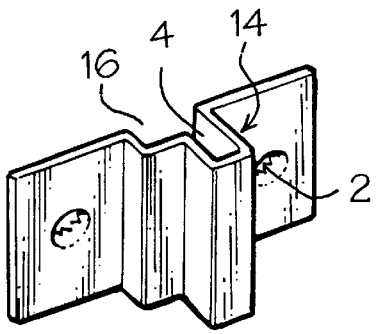
FIG. 1 is a perspective illustration of a bracket forming part of a first embodiment of the present invention and adapted to be coupled to the rear of a picture frame.

The bracket illustrated in FIG. 1 is stamped from sheet metal and provided with a suitable surface coating for preservation and/or decoration. It is rectangular in plan and is to be coupled to the rear panel of a picture frame through a pair of conventional dog tooth fittings 2 pressed out of the sheet metal itself and driven into the rear panel.

A shaped slot 4 is formed in the sheet metal of the bracket by the stamping process and has an "L" shaped internal cross section. When the bracket is mounted on the picture frame, the slot extends in the direction from the bottom of the frame to the top, the bracket being positioned near to the bottom of the frame. Some rectangular frames can be used in two different orientations, either a long edge or a short edge being lowermost and resting on the supporting surface. For such frames, two brackets of the type illustrated in FIG. 1 may be provided, one adjacent a short edge of the frame and one adjacent a long edge.

Figure 2:
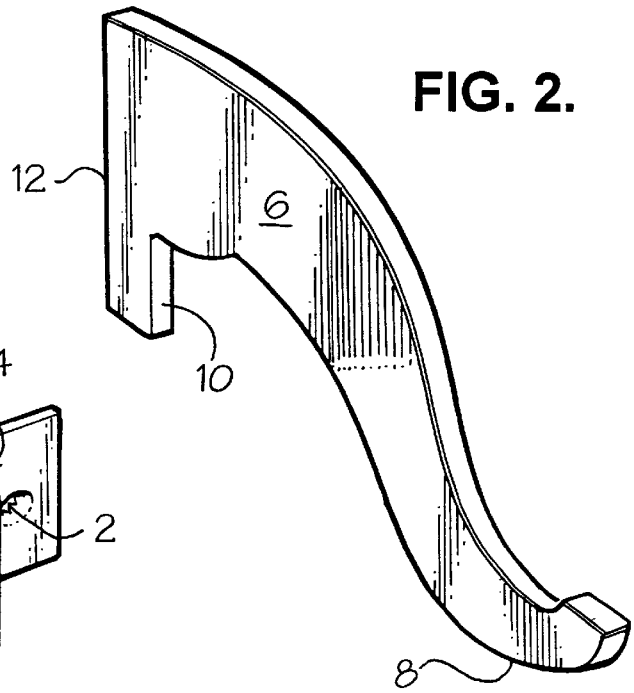
FIG. 2 is a perspective illustration of a leg also forming part of the first embodiment.

The leg illustrated in FIG. 2 is formed, like the bracket, from sheet metal with a surface coating. The leg has a main portion 6 with a foot 8 formed thereon for resting on the supporting surface, and is elbowed to also form a projection 10 of rectangular cross section for receipt in the slot 4. The leg is shown to a larger scale than its corresponding bracket in FIG. 1. The edge 12 of the leg remote from the foot is straight, to rest against the rear of the picture frame when the leg is supporting the frame.

To couple the leg to the bracket, and hence to the picture frame itself, projection is inserted downwardly into the slot 4. Because of the "L" shape of the slot, the projection can be received either such that the leg lies generally perpendicular to the bracket and the picture frame, the projection lying largely within a perpendicular portion 14 of the slot, or such that the leg lies generally parallel to and against the bracket and the picture frame, the projection lying largely within a parallel portion 16 of the slot.

In the first case the leg projects backward from the picture frame and enables it to stand generally upright on a horizontal surface—the frame inclines slightly backward and is prevented from toppling by resting of the foot 8 on the surface In the second case, the leg, being against and parallel to the rear of the frame, is conveniently retained for storage without risk of being lost.

Both the leg's projection and the slot are formed with a slight taper along their lengths, so that the former can be snugly received in the latter.

Figure 3:
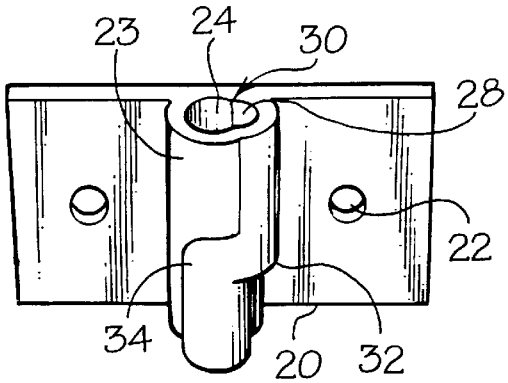
FIG. 3 is a perspective illustration of a bracket forming part of a second embodiment of the present invention.

The bracket illustrated in FIG. 3 is somewhat more constructionally complex than that of FIG. 1; it may be formed from a combination of metal sheet and molded plastics. This bracket has a planar rectangular portion 20 again provided with dog teeth surrounding a pair of apertures 22 by which it is coupled to the rear panel of a picture frame. On the rear of the planar portion 20 is formed or secured a slot defining portion 23 through which there is a cylindrical slot 24 for receiving a projection 26 of the corresponding leg (see FIG. 4) which is in this embodiment also cylindrical.

The inner surface of the cylindrical slot 24 has formed in it a longitudinally extending concave guideway 28. This runs downwardly from the open upper mouth 30 of the slot 24 in a direction parallel to the slot axis as far as a vertex 32 where the guideway diverts to a direction transverse to the slot before, at a further vertex 34, it again diverts to run downward along the slot 24 parallel to its axis.

Formed on a lower part of the cylindrical projection 26 of the leg is a follower formed as a small semi-spherical flange 36 for receipt in the guideway. Thus, as the projection is moved downward into its slot, the leg is first constrained to lie parallel to and against the picture frame suitably for storage and then, as the projection moves past the two vertices in the guideway, to lie perpendicular to the frame such that it can serve to stand the frame upright.

Either of the above described brackets can, where the frame is to be suspended from a wall rather stood on a horizontal surface, serve as a hanging point. To this end a small "V" or nick may be formed in a lower part of the bracket to receive a nail head or hook.

Figure 4:
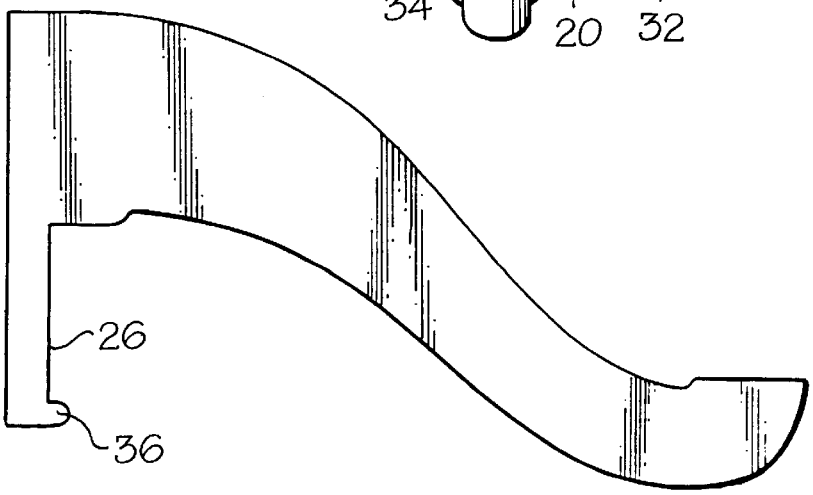
FIG. 4 illustrates a leg also forming part of the second embodiment.

The embodiment of the present invention illustrated in FIGS. 5 and 6 is akin to that shown in FIGS. 3 and 4 in that the leg can be moved from one orientation to the other without removal from the slot.

In this embodiment both the leg 40 and the bracket 42 are formed of sheet metal, the material of the leg being somewhat thicker than that of the bracket.

The leg has, close to the lower end of its projection 44, an integrally formed stub 46.

The bracket 42 defines a slot 48 whose cross section is a ninety degree segment of a circle, the sheet material of the bracket being shaped to provide a substantially perpendicular wall part 50 adjacent a quarter circular part 52.

The quarter circular part 52 is cut through such that it defines a guide path 54 having a first portion 56 extending longitudinally of the slot 48 and leading to a second portion 58 extending laterally which itself leads into a third portion 60 extending longitudinally.

In use, the projection 44 of the leg is inserted in the slot with its stub 44 engaged in the cut through guide path 54, so that the leg can be located adequately securely in either of its orientations at the option of the user.

The bracket has a "V" shaped cut-away 62 which, on inverting the frame, will engage on a wall mounted pin, nail, hook or similar to hang the frame. When the frame is used in this way, the leg can be stored in its non-use position.

The sheet material forming the bracket 42 is divided along the greater part of its length by the guide path 54. To prevent relative motion of the material on either side of the guide path, the bracket is secured to a back plate 66 which rests against the rear of the frame.

Another suitable construction of the bracket part of the stand is illustrated in FIG. 7. This bracket 70 is usable with a leg of the type illustrated in FIG. 2. As compared with the bracket illustrated in FIG. 1, the bracket 70 is considered to give more positive location for the leg. It defines a pair of parallel slots 72, 74 one adjacent, but separated from, the other. One slot 72 receives the rectangular leg projection when the leg is in its "in use" position, projecting from the rear of the frame. The other slot 74 has the same cross section as the one slot 72 but is oriented at 90 degrees thereto and so receives the projection when the leg is in its "storage" position adjacent the rear of the frame.

Both slots being too narrow (along most of their lengths) to receive a hook or nail head, the slot 72 has been flared at one of its ends 76—the lowermost end in use—and nicked at 78 to adapt it to serve as means for hanging the frame when the leg is not in use.

Figure 8:
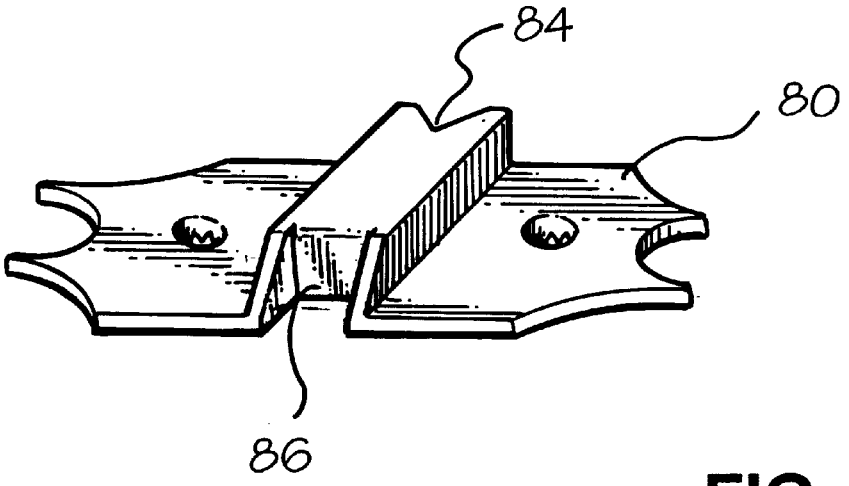
FIG. 8 illustrates in perspective a bracket forming part of a fifth embodiment of the present invention.
Figure 9:
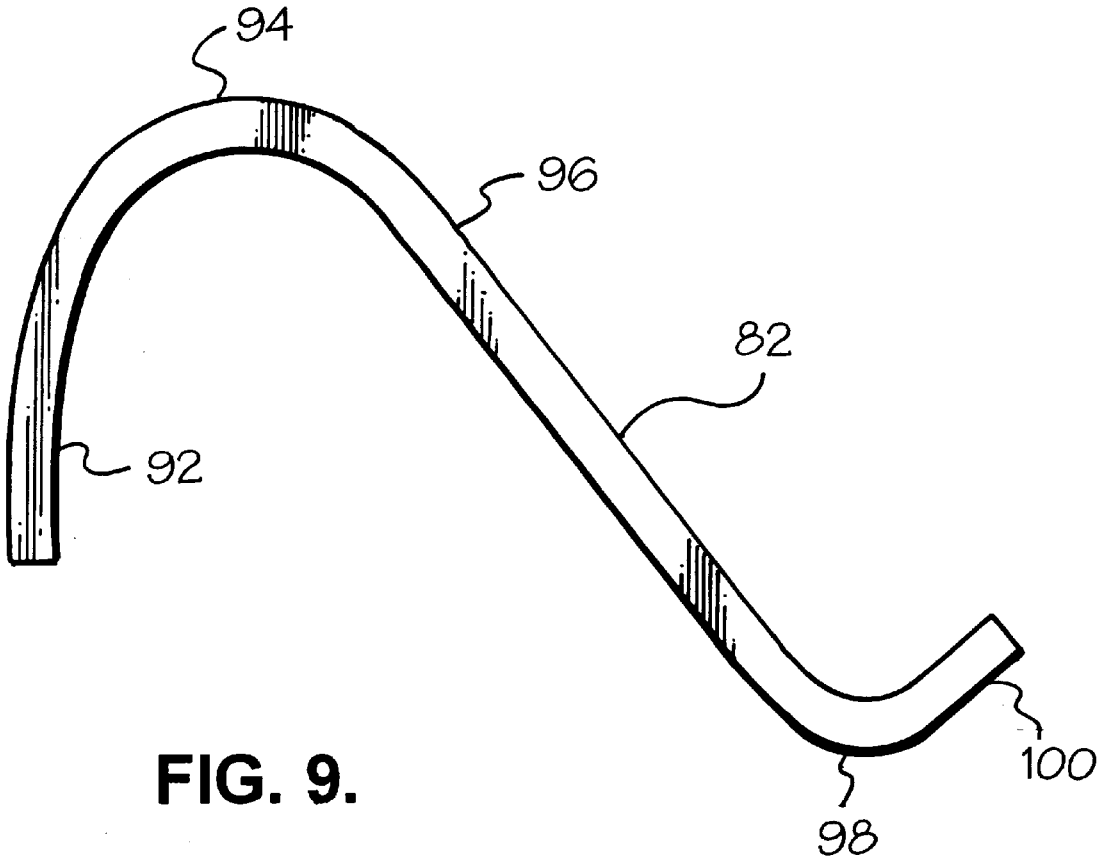
FIG. 9 is a plan view of a leg used in the fifth embodiment.

FIGS. 8 and 9 illustrate a particularly constructionally convenient embodiment of the present invention in which the bracket 80 defines a slot 84 of square cross section and the corresponding leg 82 is likewise square, being formed in this version from square wire appropriately shaped. One end of the slot 84 is closed by a downwardly turned flap 86 which can be formed during the stamping process used to manufacture the bracket and which serves to prevent the lower end of the portion of the leg inserted into the slot from emerging.

Viewed in its in-use orientation, the leg comprises a first straight portion 92 leading via a downwardly turned elbow 94 to an inclined portion 96 which in turn leads to an upwardly turned foot 98 and then to a second straight portion 100.

Figure 10:
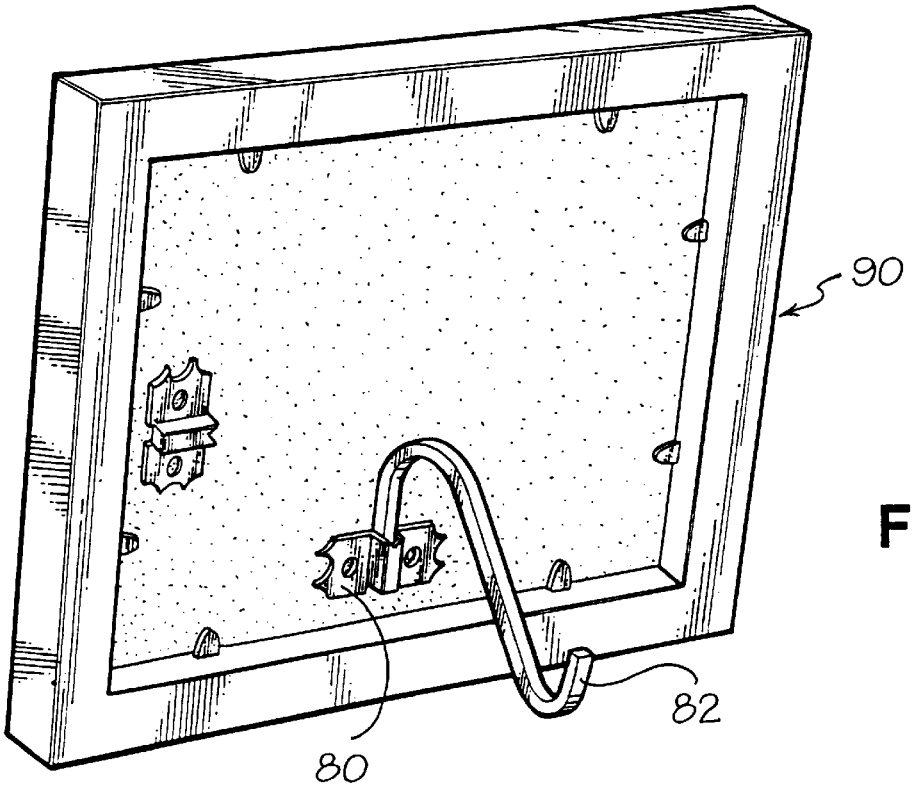
FIG. 10 is a perspective illustratio n of the fifth embodiment in use on a picture frame.

In FIG. 10, this embodiment of the invention is seen in use in conjunction with a picture frame 90, the bracket being secured to the rear panel of the frame by its dog teeth with the open end of the slot 84 facing away from the adjacent portion of the perimeter frame to receive the first straight portion 92 of the leg 82. The leg itself projects perpendicularly backward from the frame's rear panel, its foot 98 resting on a supporting surface to stably support the frame.

Figure 11:
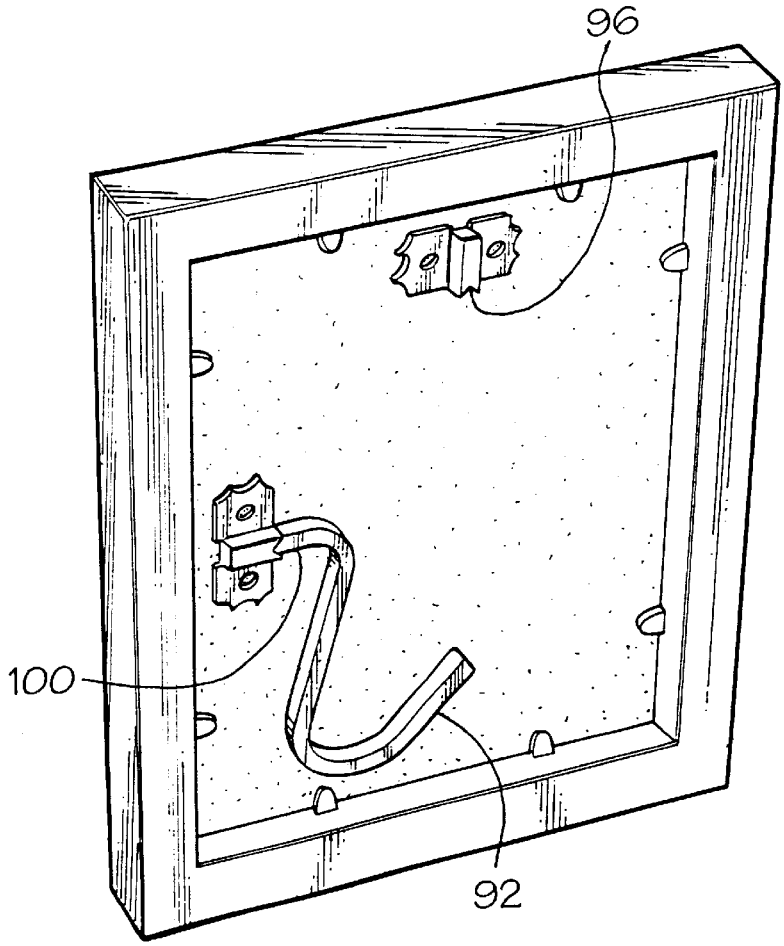
FIG. 11 illustrates the stand and picture frame of FIG. 10 but shows the stand configured for storage.

In FIG. 11, the same embodiment is seen with the leg in its storage position. Here, the straight portion 100 (rather than the opposite end portion 92) has been inserted in the bracket 80 and the leg lies adjacent and parallel to the rear panel of the frame.

The arrangement of FIGS. 10 and 11 includes a pair of brackets 80 mutually perpendicularly aligned, one adjacent a short edge of the frame (the frame being rectangular) and one adjacent a long edge of the frame. Thus by inserting the leg in one or other of the brackets the frame can be supported either with a long edge horizontal on the supporting surface as illustrated (often referred to as "landscape mode") or with its short edge on the supporting surface ("portrait mode").

In FIG. 11, the frame is oriented in portrait mode but with the one bracket toward the top of the frame. A "V" cut-away 96 is consequently downwardly open and can receive means for hanging the frame—a nail, pin, hook etc.

What is claimed is:

1. A stand for a picture frame having a standing position, comprising a bracket for coupling to the picture frame and a leg, one of the leg and the bracket defining at least one slot and the other of the leg and the bracket comprising a projection receivable in said slot to thereby mount the leg on the frame to the bracket the leg and the at least one slot being shaped such that in use the leg can be thereby mounted on the frame to the bracket in either of a first orientation relative to the frame in which the leg lies substantially parallel to the frame to minimize bulk and a second orientation relative to the frame in which the leg projects backward from the frame and can thus support the frame in said standing position wherein the projection and the slot are shaped to register in such a manner that following insertion of the projection into the slot the leg cannot be moved from its first to its second orientation without removal from the slot.

2. A stand according to claim 1 wherein the projection is receivable along a direction which is generally upright with respect to the picture frame's standing position.

3. A stand according to claim 1 wherein the leg has an abutment surface for contacting the picture frame in use when the leg is in its second orientation and thereby resisting rotational movement of the leg relative to the picture frame.

4. A stand according to claim 1 wherein the leg is formed as a single component of shaped wire.

5. A stand according to claim 1 wherein the leg has a support portion which meets the projection in an elbow, the support portion being adapted to extend backwardly from the picture frame when said bracket is coupled to said picture frame and when the leg is in its second orientation and said picture frame is in said standing position on a supporting surface, the support portion being adapted to rest on the supporting surface and so support the picture frame in its standing position.

6. A stand according to claim 1, wherein the slot has a square cross section and the projection has a complementary square cross section.

7. A stand according to claim 1, wherein the slot is generally L shaped in cross section, the projection being generally rectangular in cross section and so receivable by the slot in at least two different orientations, one substantially perpendicular to the other.

8. A stand according to claim 1 in which the bracket defines two differently orientated slots such that the leg lies in the first orientation when received in one slot and in the second orientation when received in the other slot.

9. A stand according to claim 1 wherein the slot is defined by the bracket and is adapted to be upwardly open when the bracket is coupled to the picture frame and the picture frame is in its standing position, and the projection is formed on the leg and is insertable generally downwardly into the slot.

10. A stand according to claim 1 wherein the bracket is adapted to receive means for hanging the picture frame and so to enable hanging of the picture frame therefrom.

11. A stand according to claim 10 wherein the bracket comprises a cut away region for receipt of means for hanging the picture frame.

12. A stand according to claim 11 wherein the cut away region is formed in a part of the bracket defining the slot.

13. A stand according to claim 1 wherein the leg has two ends both of which form respective projections for receipt by the bracket, the shape of the leg and of the bracket being such that one of the projections can be received by the bracket to mount the leg in its first orientation and the other of the projections can be received by the bracket to mount the leg in its second orientation.

14. A picture frame having a standing position, provided with a stand comprising a bracket coupled to the picture frame to the bracket and a leg, one of the leg and the bracket defining at least one slot and the other of the leg and the bracket comprising a projection receivable in the slot to thereby mount the leg on the picture frame to the bracket, the leg and the at least one slot being shaped such that the leg can be thereby mounted on the picture frame to the bracket in either of a first orientation, in which the leg lies substantially parallel to the picture frame to minimize bulk, and a second orientation, in which the leg projects backward from the picture frame and can thus support the picture frame in said standing position wherein the projection and the slot are shaped to register in such a manner that following insertion of the projection into the slot the leg cannot be moved from its first to its second orientation without removal from the slot.

15. A picture frame according to claim 14 wherein the projection is receivable along a direction which is generally upright with respect to the picture frame's standing position.

16. A picture frame according to claim 14 wherein the leg has an abutment surface which contacts the picture frame in use and so resists rotational movement of the leg relative to the picture frame.

17. A picture frame according to claim 14 wherein the leg is formed as a single component of shaped wire.

18. A picture frame according to claim 14 wherein the leg has a support portion which meets the projection in an elbow, the support portion being adapted to extend backwardly from the picture frame when said picture frame is in its standing position on a supporting surface, and when the leg is in its second orientation, said support portion being adapted to rest on the supporting surface and so support the picture frame in its standing position.

19. A picture frame according to claim 14, wherein the slot has a square cross section and the projection has a complementary square cross section.

20. A picture frame according to claim 14, wherein the slot is generally L shaped in cross section, the projection being generally rectangular in cross section and so receivable by the slot in at least two different orientations, one substantially perpendicular to the other.

21. A picture frame according to claim 14 in which the bracket defines two differently orientated slots such that the leg lies in the first orientation when received in one slot and in the second orientation when received in the other slot.

22. A picture frame according to claim 14 wherein the slot is defined by the bracket and is adapted to be upwardly open when the picture frame is in its standing position and the projection is formed on the leg and is insertable generally downwardly into the slot.

23. A picture frame according to claim 14 wherein the bracket is formed of stamped sheet metal defining a plane and is capable of being coupled to the picture frame by integrally formed dogs pressed out of the plane of the sheet metal and driven into a board forming the picture frame.

24. A picture frame according to claim 14 wherein the bracket is adapted to receive means for hanging the picture frame and so to enable hanging of the picture frame therefrom.

25. A picture frame according to claim 24 wherein the bracket comprises a cut away region for receipt of means for hanging the picture frame.

26. A picture frame according to claim 25 wherein the cut away region is formed in a part of the bracket defining the slot.

27. A picture frame according to claim 14 wherein the leg has two ends both of which form respective projections for receipt by the bracket, the shape of the leg and of the bracket being such that one of the projections can be received by the bracket to mount the leg in its first orientation and the other of the projections can be received by the bracket to mount the leg in its second orientation.

28. A picture frame according to claim 14 comprising at least one further bracket for engaging the leg in either of two different orientations.

29. A stand for maintaining in a standing orientation an item otherwise unstable in such orientation, the stand comprising a bracket for coupling to the item and a leg, one of the bracket and the leg defining at least one slot and the other of the bracket and the leg comprising a projection receivable in the slot to thereby mount the leg on the item to bracket, the leg and the at least one slot being shaped such that the leg can be thereby mounted on the item to the bracket in either of a first orientation in which the leg lies substantially adjacent the item to minimize bulk and a second orientation in which the leg projects from the item suitable to support the item in the standing orientation wherein the projection and the slot are shaped to register in such a manner that following insertion of the projection into the slot the leg cannot be moved from its first to its second orientation without removal from the slot.

* * * * *